US007503419B2

(12) United States Patent
Miyake

(10) Patent No.: US 7,503,419 B2
(45) Date of Patent: Mar. 17, 2009

(54) BACKHOE

(75) Inventor: Tomoaki Miyake, Sakai (JP)

(73) Assignee: Kubota Corporation, Osaka (JP)

( * ) Notice: Subject to any disclaimer, the term of this patent is extended or adjusted under 35 U.S.C. 154(b) by 63 days.

(21) Appl. No.: 11/511,884

(22) Filed: Aug. 29, 2006

(65) Prior Publication Data

US 2007/0068722 A1 Mar. 29, 2007

(30) Foreign Application Priority Data

Sep. 26, 2005 (JP) ..... 2005-278888
Sep. 26, 2005 (JP) ..... 2005-278889

(51) Int. Cl.
*B62D 33/08* (2006.01)

(52) U.S. Cl. ..... 180/327; 180/326; 296/190.08

(58) Field of Classification Search ..... 180/327, 180/326, 329, 331, 89.1, 69.21; 37/466, 37/348, 443, 347; 296/190.01, 190.08
See application file for complete search history.

(56) References Cited

U.S. PATENT DOCUMENTS 4,771,855 A * 9/1988 Takashima et al. ..... 180/326
5,715,615 A * 2/1998 Murakami et al. ..... 37/379
6,009,643 A * 1/2000 Maeba et al. ..... 37/443
6,170,588 B1 * 1/2001 Irino et al. ..... 180/89.1
6,615,942 B2 * 9/2003 Shinohara et al. ..... 180/69.21
6,757,993 B2 * 7/2004 Kondou ..... 37/348
6,922,925 B2 * 8/2005 Watanabe et al. ..... 37/466
7,204,047 B2 * 4/2007 Murakami ..... 37/347
7,320,380 B2 * 1/2008 Ueda et al. ..... 180/327

FOREIGN PATENT DOCUMENTS

JP 2005-232795 9/2005

* cited by examiner

*Primary Examiner*—Hau V Phan
(74) *Attorney, Agent, or Firm*—The Webb Law Firm

(57) ABSTRACT

An improvement is realized in mutual assembly strength between a swing bearing member and right and left longitudinal ribs, and welds are subjected to a reduced stress concentration. A backhoe comprises a swivel deck (10); a first longitudinal rib (19L) disposed on the swivel deck, the first longitudinal rib extending in a fore and aft direction, and having a front portion (19La) extending in a transverse direction; a second longitudinal rib (19R) disposed on said swivel deck, the second longitudinal rib extending in the fore and aft direction, and having a front end thereof connected to the front portion of the first longitudinal rib; and a swing bearing member (20) attached to a front surface of the front portion of the first longitudinal rib for supporting a ground working implement through a swing shaft.

5 Claims, 13 Drawing Sheets

BACKHOE

BACKGROUND OF THE INVENTION

1. Field of the Invention

This invention relates to a backhoe having a ground working implement connected to the front of a swivel deck.

2. Description of the Related Art

In this type of conventional technique, a support frame bifurcated in plan view has a right and left longitudinal ribs and a front swing bearing member on the swivel slide. The swing bearing member of the support frame supports the ground working implement through a swing shaft. A hydraulic oil tank and a fuel tank are arranged at the right-hand side on the swivel slide, and a swing cylinder for swinging the ground working implement is disposed below these tanks. An engine and a counter weight are arranged on a rear portion of the swivel deck (see Japanese Unexamined Patent Publication No. 2005-232795, for example).

In the above conventional technique, the forward ends of the right and left longitudinal ribs are welded to right and left rear positions of the swing bearing member. The welds are short, and stress tends to concentrate on the welds. The right and left longitudinal ribs are not connected to each other, and it is therefore difficult to improve their mounting strength.

SUMMARY OF THE INVENTION

This invention intends to provide a backhoe that overcomes the disadvantages of the prior art noted above.

An object of this invention, therefore, is to provide a backhoe with improved mutual assembly strength between a swing bearing member and right and left longitudinal ribs, and with a reduced stress concentration occurring at welds.

The above object is fulfilled, according to this invention, by a backhoe comprising:

a swivel deck;

a first longitudinal rib disposed on the swivel deck, the first longitudinal rib extending in a fore and aft direction, and having a front portion extending in a transverse direction;

a second longitudinal rib disposed on the swivel deck, the second longitudinal rib extending in the fore and aft direction, and having a front end thereof connected to the front portion of the first longitudinal rib; and a swing bearing member attached to a front surface of the front portion of the first longitudinal rib for supporting a ground working implement through a swing shaft.

This construction realizes an improvement in mutual assembly strength between the front portion of the first longitudinal rib, the front portion of the second longitudinal rib and the swing bearing member. Welds between these parts are subjected to a reduced stress concentration.

The first longitudinal rib may include an inclined portion extending rearward and outward from the front portion, and a rear portion extending from a rear end of the inclined portion transversely away from the second longitudinal rib.

Then, the first longitudinal rib forms an approximately S-shape in plan view. This shape can distribute stress applied thereto, and can improve strength in the transverse direction of the swivel deck.

The second longitudinal rib may extend from front to rear of the swivel deck, and support an engine.

Then, the second longitudinal rib can be used not only for supporting a swing cylinder on the swivel deck, but also for mounting structures such as the engine.

Preferably, the backhoe further comprises a rear longitudinal rib extending rearward from the backward portion, and a connecting member for connecting a rear end of the second longitudinal rib and a rear end of the rear longitudinal rib.

This construction allows the two longitudinal ribs to reinforce each other, and distribute stress between each other.

According to this invention, an improvement is realized in mutual assembly strength between the front portion of the first longitudinal rib, the front portion of the second longitudinal rib and the swing bearing member, and welds between these parts are subjected to a reduced stress concentration.

DESCRIPTION OF THE PREFERRED EMBODIMENT

Figure 1:
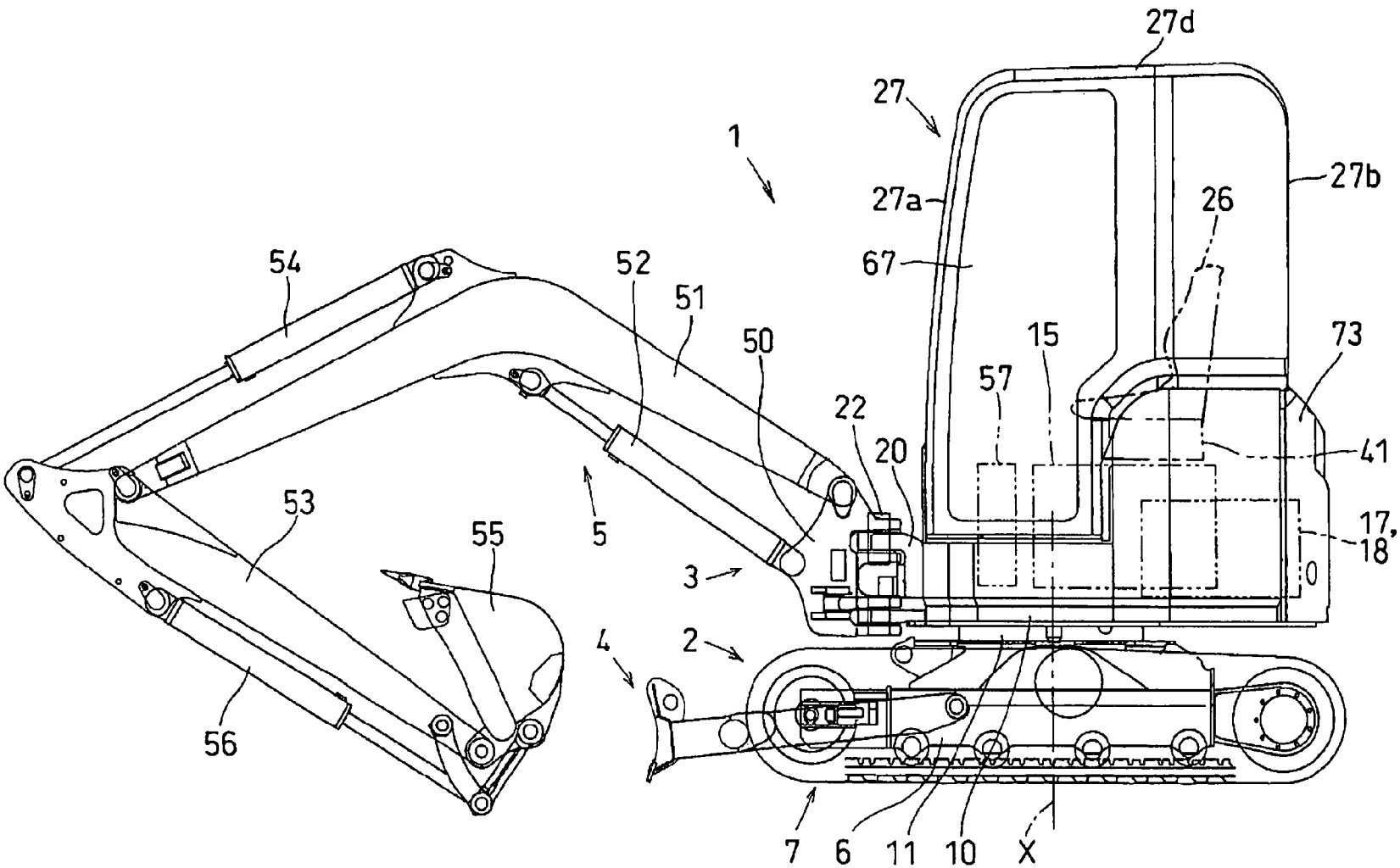
FIG. 1 is a side elevation of a backhoe according to this invention.
Figure 2:
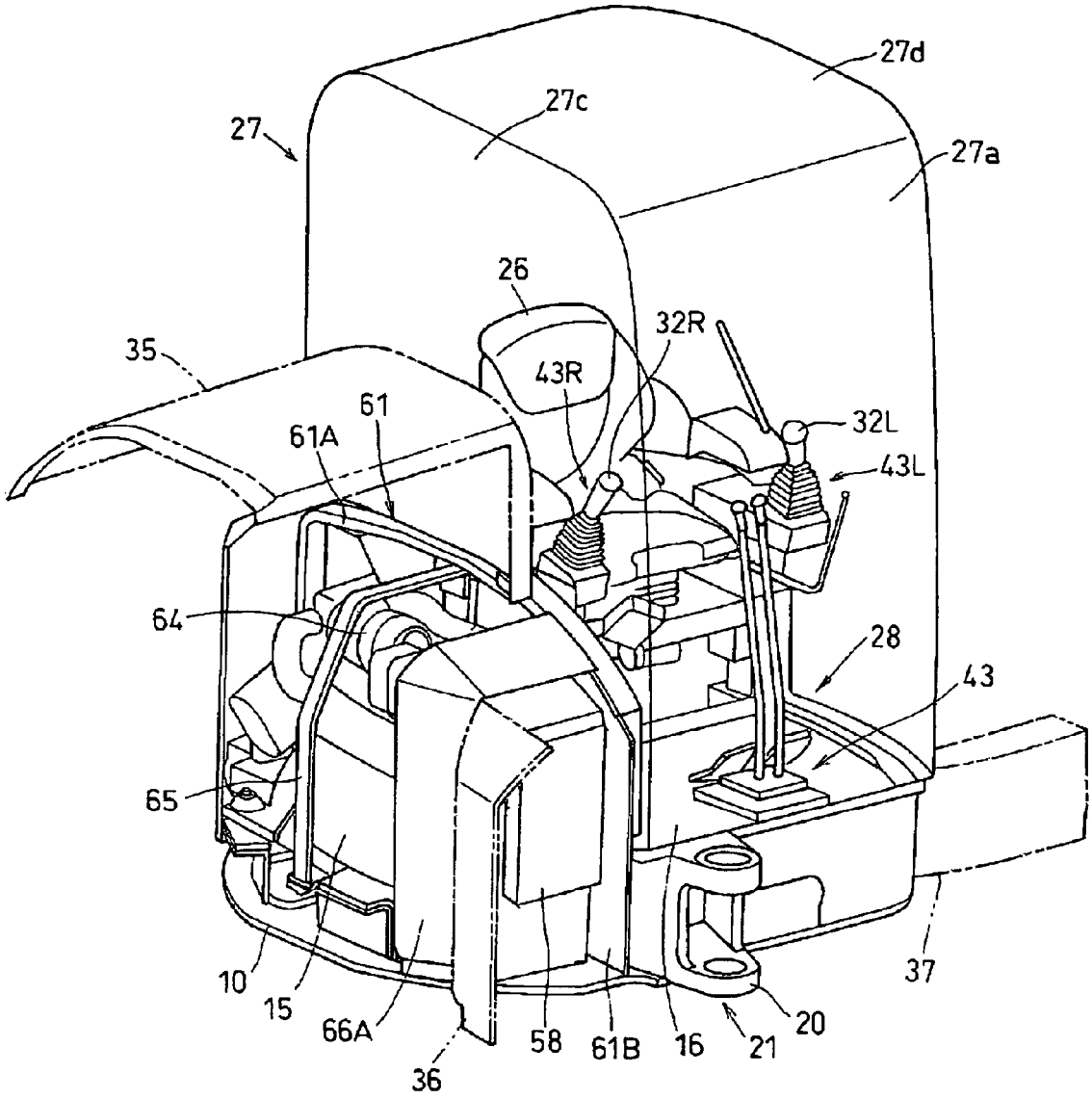
FIG. 2 is a perspective view of the backhoe seen from a right forward direction.
Figure 3:
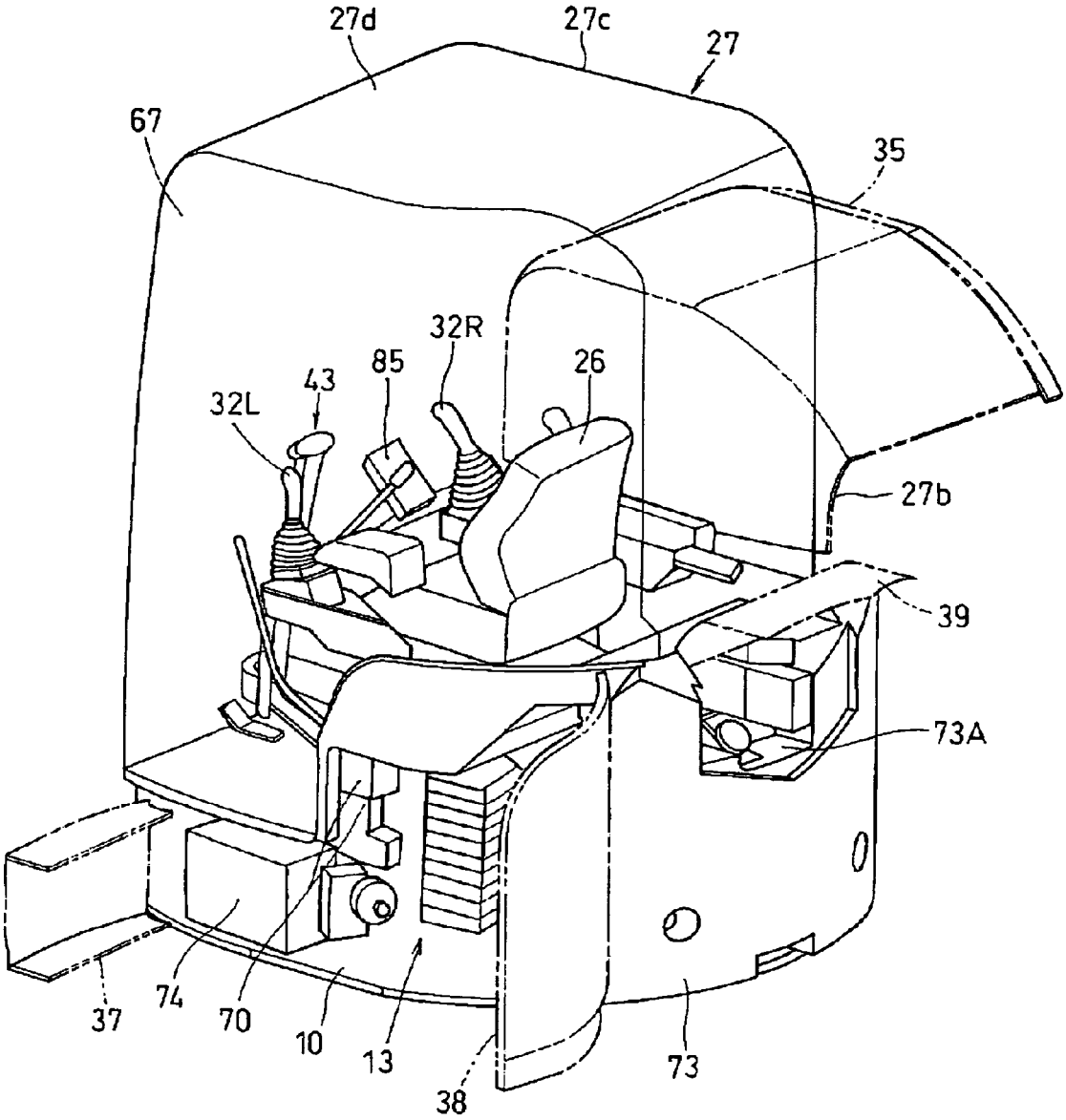
FIG. 3 is a perspective view of the backhoe seen from a left rearward direction.

An embodiment of this invention will be described hereinafter with reference to the drawings.

In FIGS. 1-14, a backhoe 1 of the rear small revolution type (swivel type working vehicle), includes a traveling device 2 disposed below, an upper structure 3 disposed above, a dozer apparatus 4 attached to the front of the traveling device 2, and a ground working implement 5 attached to the upper structure 3.

The traveling device 2 has crawler traveling means 7 arranged at right and left side of a track frame 6 to be driven by hydraulic motors. The track frame 6 supports thereon a swivel deck 10 which is a base of the upper structure 3, to be swivelable through a swivel bearing 11 about a swivel center (vertical axis) X. The swivel deck 10 is driven by a swivel motor 8 mounted thereon. The dozer apparatus 4 has a blade vertically movable in front of the track frame 6.

The track frame 6 has a swivel joint 12 disposed centrally of the swivel bearing 11. The swivel joint 12 projects into the swivel deck 10.

The track frame 6 has the swivel bearing 11 disposed on an upper surface of a top plate thereof for swivelably supporting the swivel deck 10, and a swivel gear disposed in an inner peripheral position of the swivel bearing 11. A mounting member is attached to a lower surface of the top plate. An attachment part of the swivel joint 12 is fixed to a lower surface of the mounting member. The swivel joint 12 is disposed centrally of a center opening of the top plate.

Referring to FIGS. 2-7, the upper structure 3 includes, arranged on the swivel deck 10 and with reference to the swivel center X where the swivel joint 12 is located, an engine 15 at one side (right-hand side), a platform 16 at the other side (left-hand side), and a hydraulic oil tank 17 and a fuel tank 18 at the rear. A driver's seat 26 on the platform 16 is disposed adjacent the center of the swivel deck 10 and above the hydraulic oil tank 17 and fuel tank 18.

The platform 16 may have, mounted thereon, a rollover protection structure of the four strut type or two strut type, or a cab body 27A forming a cab apparatus 27.

On the swivel deck 10 a support frame 21 bifurcated in plan view is provided, which includes right and left longitudinal ribs 19R and 19L and a swing bearing member 20 at the front. The ground working implement 5 is supported by the swing bearing member 20 of the support frame 21 through a swing shaft 22. A swing cylinder 23 is disposed at the left-hand side on the swivel deck 10 for swinging the ground working implement 5.

The swing shaft 22 is displaced to one side (right-hand side) from the swivel center X. The center of the driver's seat 26 is displaced to the other side (left-hand side) for enabling the driver to observe operating states of the ground working implement 5.

The engine 15 is disposed on the swivel deck 10 further rightward than the longitudinal rib 19R at the right-hand side, with a crankshaft 15A extending in the fore and aft direction. A radiator 57 and an oil cooler 58 are arranged forwardly of the engine 15, and a hydraulic pump 59 rearwardly of the engine 15.

As shown in detail in FIGS. 6-10, the support frame 21 has the right longitudinal rib 19R (corresponding to the second longitudinal rib of this invention) extending substantially in the fore and aft direction and substantially parallel to the engine 15. The left longitudinal rib 19L (corresponding to the first longitudinal rib of this invention) has a front portion 19La extending in a right and left direction and connected to the front of the right longitudinal rib 19R. The swing bearing member 20 is attached to the front portion 19La.

The front portion 19La has a front surface of substantially the same vertical dimension as a rear surface of the swing bearing member 20, and slightly longer in the right and left direction than the rear surface. Parts thereof protruding right and left serve as welds to the swing bearing member 20. The lower surface of the front portion 19La is welded to the swivel deck 10. The upper surface of the front portion 19La defines a mounting surface in combination with an upper rear part of the swing bearing member 20 for supporting the platform 16 through a cushion material 76.

The left longitudinal rib 19L includes the front portion 19La, an inclined portion 19Lb extending rearward and outward from the front portion 19La, a rear portion 19Lc extending leftward from the rear end of the inclined portion 19Lb and supporting the swing cylinder 23, and a tail portion 19Ld bent rearward from rear portion 19Lc. The rear portion 19Lc also extends in the right and left direction and substantially parallel to the front portion 19La.

A connecting part between the forward portion l9La and right longitudinal rib 19R is reinforced with a coupling member 86. A coupling member similar to the coupling member 86 may be provided for a bend between the front portion 19La and inclined portion 19Lb.

A pair of upper and lower brackets 23 are formed on a front surface of the rear portion 19Lc for pivotally supporting a proximal portion of the swing cylinder 23 through a pin. The upper bracket 23*a* is welded also to the inclined portion 19Lb to reinforce the bend between the inclined portion 19Lb and rear portion 19Lc.

A rear longitudinal rib 24 extends from the rear portion 19Lc of left longitudinal rib 19L to the rear of the swivel deck 10. The rear longitudinal rib 24 is connected to the rear end of the right longitudinal rib 19R by a connecting member 25. The support frame 21, including the rear longitudinal rib 24 and connecting member 25, has a closed frame configuration approximately in the shape of a trapezoid. This support frame 21 is strong particularly against loads acting in the fore and aft direction.

The left longitudinal rib 19L curved to form an approximately S-shape in plan view has high strength for attaching to the swivel deck 10, serves to increase strength in the right and left direction of the swivel deck 10, and also increases mounting strength of the rear longitudinal rib 24 and connecting member 25.

The right longitudinal rib 19R adjacent the engine 15 extends from front to rear of the swivel deck 10 to serve as a lower partition of an engine room 14 and define a space for arranging the engine room 14, hydraulic oil tank 17 and fuel tank 18. A longitudinal frame 61 of the engine room 14 extends upward from the right longitudinal rib 19R.

Mounting members l9Ra and l9Rb are provided in forward and rearward positions of the right longitudinal rib 19R. The engine 15 is mounted on the mounting members l9Ra and l9Rb and forward and rearward mounting bases 63 arranged at the right end of the swivel deck 10. An accessory frame 65 extends between the mounting members l9Ra and l9Rb and mounting bases 63, straddling the engine 15, for supporting engine accessories such as an air cleaner. The engine 15 is mounted using the right longitudinal rib 19R, and is connected to the right longitudinal rib 19R, thereby reinforcing the right longitudinal rib 19R. The accessory frame 65 also reinforces the right longitudinal rib 19R.

Referring to FIGS. 2, 7, 13 and 14, the longitudinal frame 61 has a square frame 61A, a front partition plate 61B, a rear partition plate (not shown) and a cover frame 66 arranged between the engine room 14 and platform 16 (or cab apparatus 27), and is fixed to the accessory frame 65 and right longitudinal rib 19R.

The square frame 61A is formed of an angle pipe looped into a square to serve as a reinforcing member. The front partition plate 61B is disposed at the front of the square frame 61A to cover the left-hand plane of the engine room 14. The rear partition plate is disposed at the rear of the square frame 61A to form a tank arranging space, and serve as a member for supporting an oil filter 88. The front partition plate 61B and rear partition plate are fixed to the right longitudinal rib 19R.

The cover frame 66 covers upper edges of the square frame 61A and front partition plate 61B, and has a cover portion 66A covering an upper surface and a right-hand side surface of the radiator 57.

The front partition plate 61B may extend to the rear partition plate to cover the entire surface of the square frame 61A, i.e. to cover the entire left-hand side plane of the engine room 14.

The accessory frame 65 has a band plate between the square frame 61A and the right end of the swivel deck 10, and a band plate between the square frame 61A and right longitudinal rib 19R, and is located an intermediate position in the fore and aft direction of the engine room 14.

The longitudinal frame 61 and/or accessory frame 65 pivotally support a hood 35 covering the engine room 14, to be openable about an axis extending in the fore and aft direction. When the cab apparatus 27 is mounted, an upper part of the side wall adjacent the engine of the cab apparatus 27 is disposed to overlap the top of the longitudinal frame 61.

Figure 4:
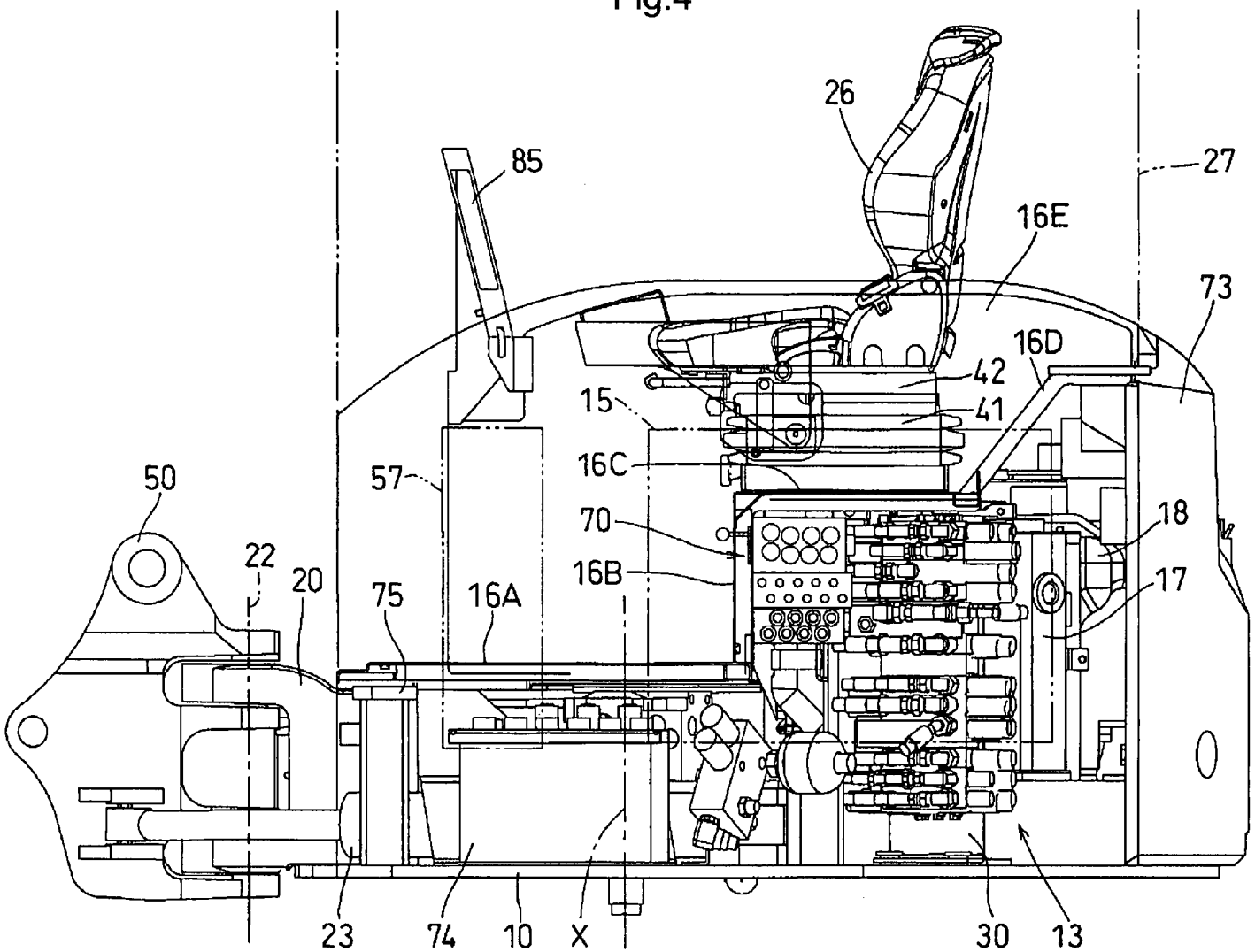
FIG. 4 is a side view of an upper structure.
Figure 5:
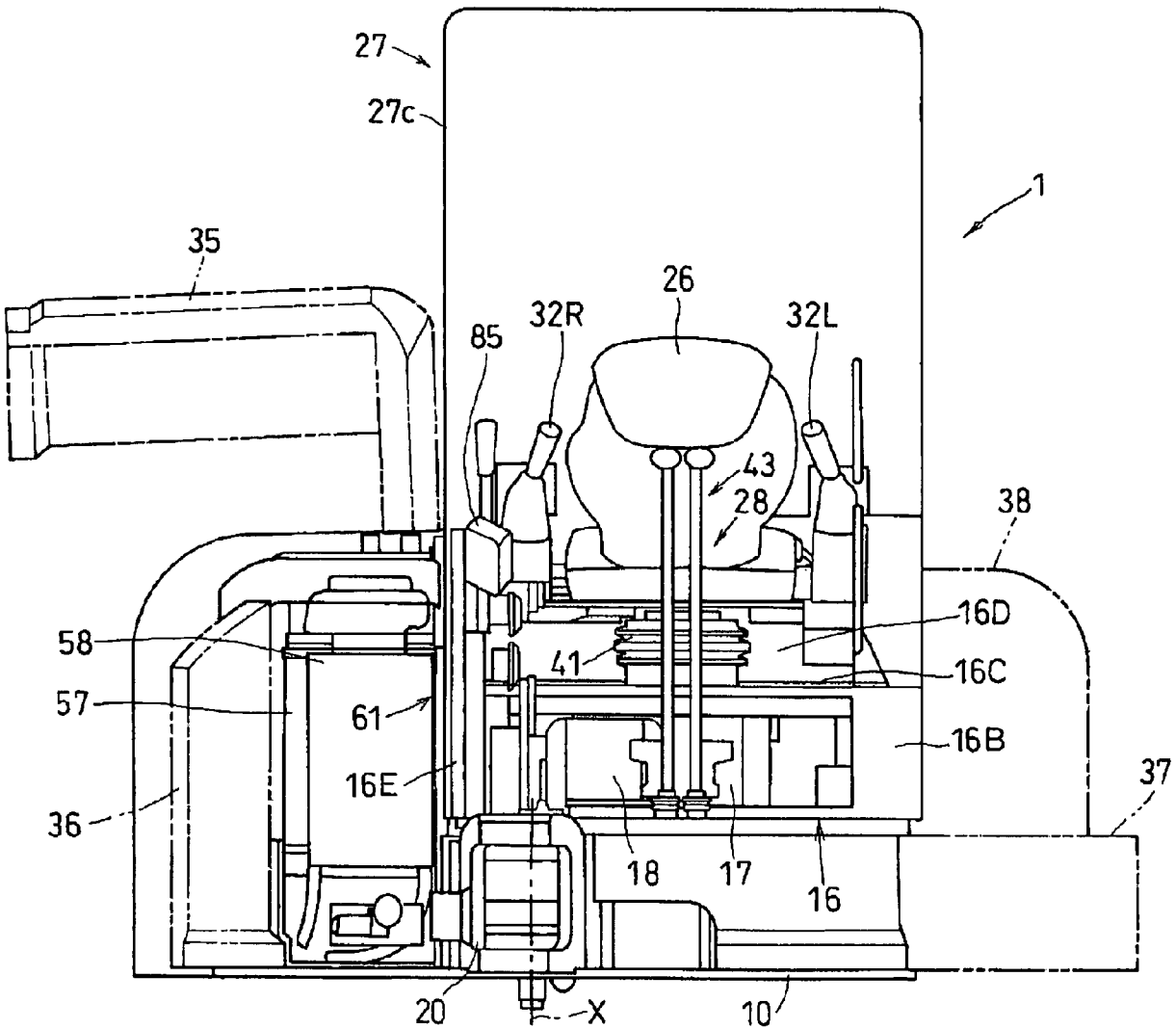
FIG. 5 is a front view of the upper structure.
Figure 6:
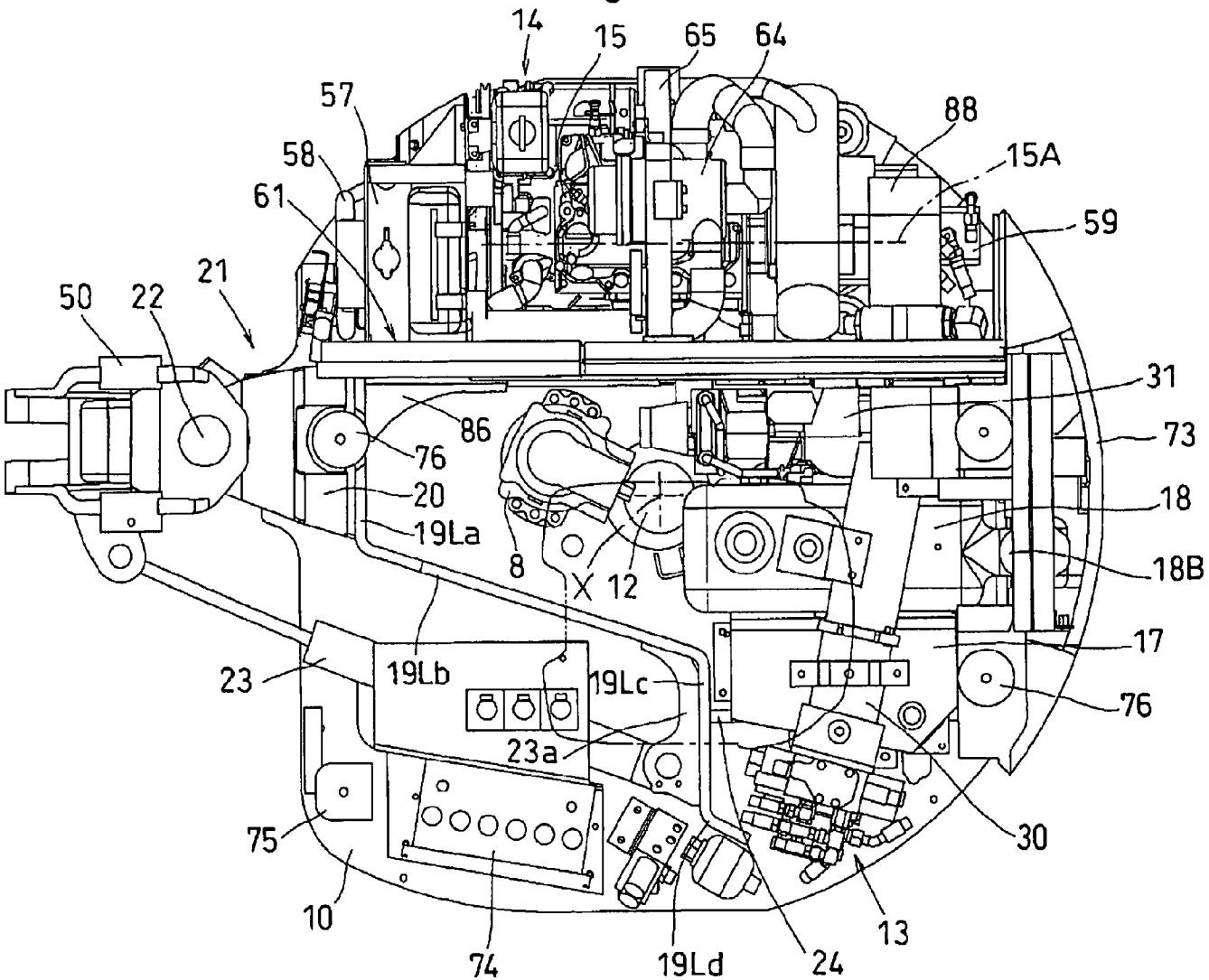
FIG. 6 is a plan view of an interior of the upper structure.
Figure 7:
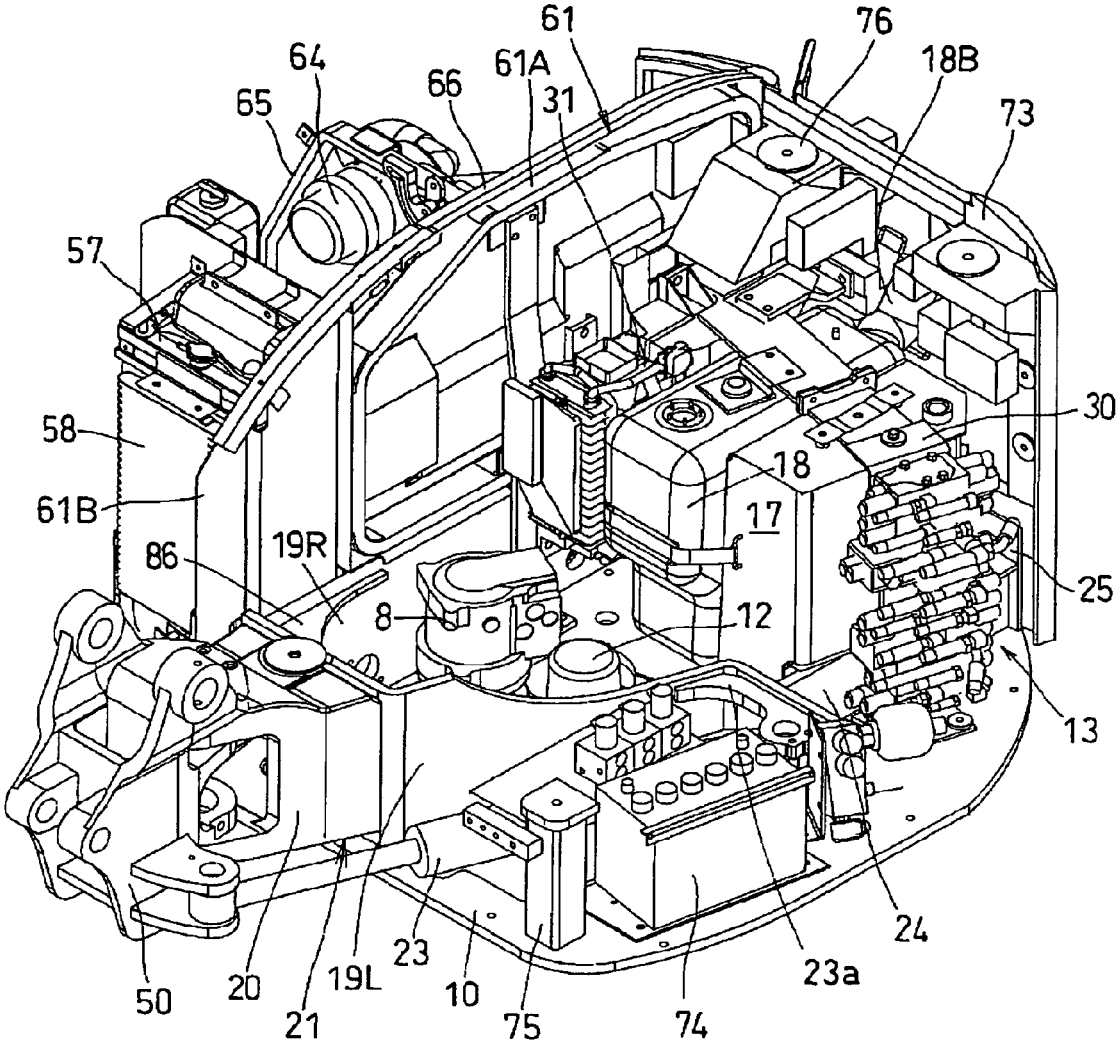
FIG. 7 is a perspective view of the interior of the upper structure.
Figure 8:
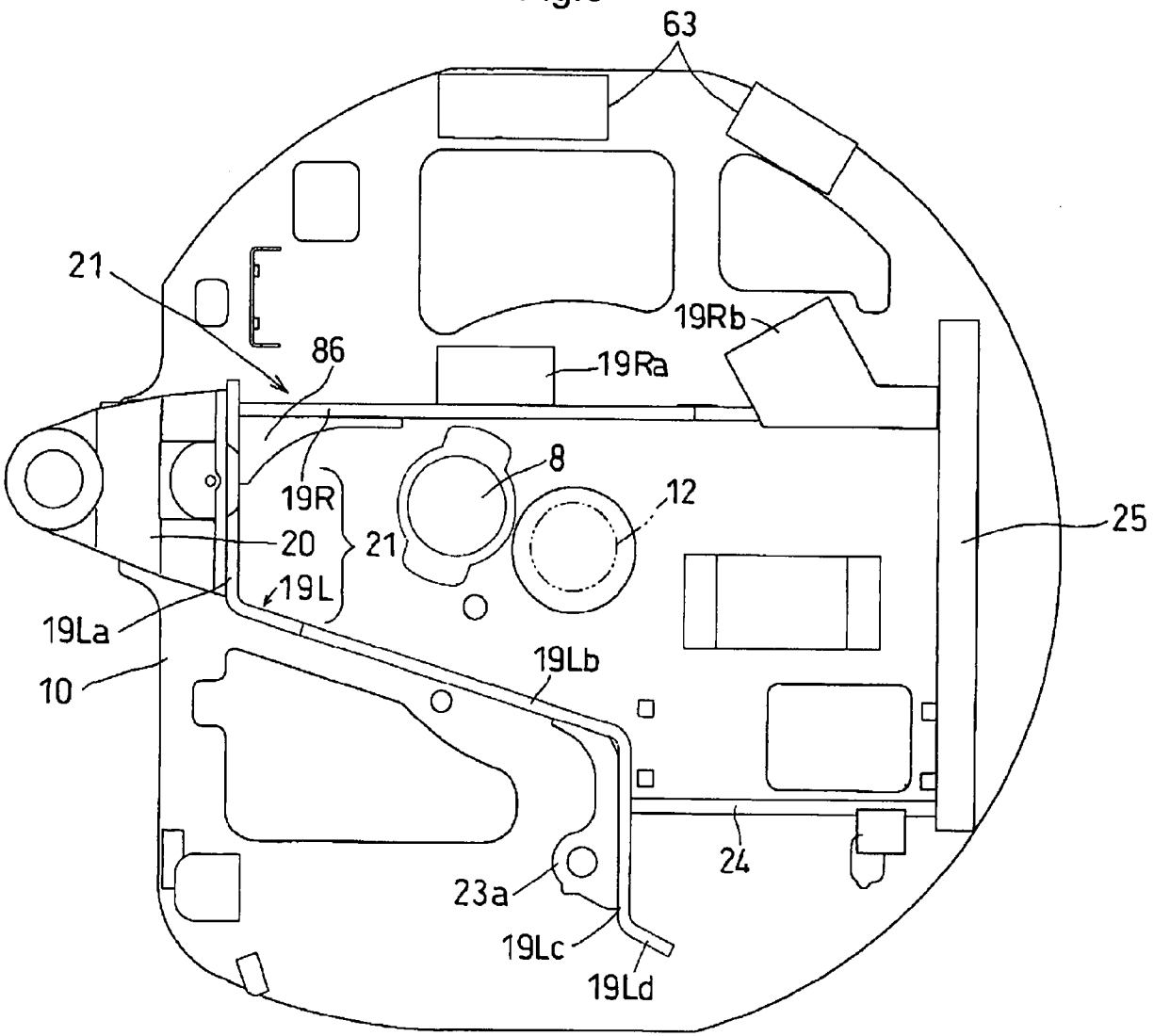
FIG. 8 is a plan view of a swivel deck.
Figure 9:
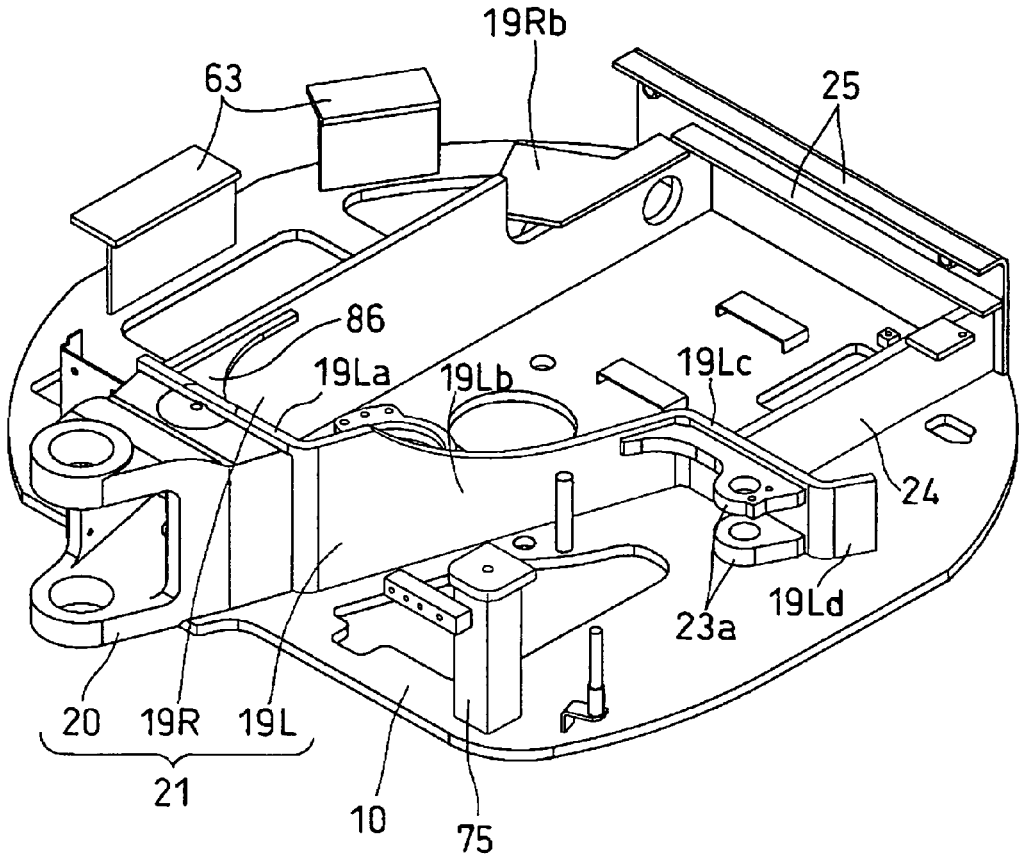
FIG. 9 is a perspective view of the swivel deck.
Figure 10:
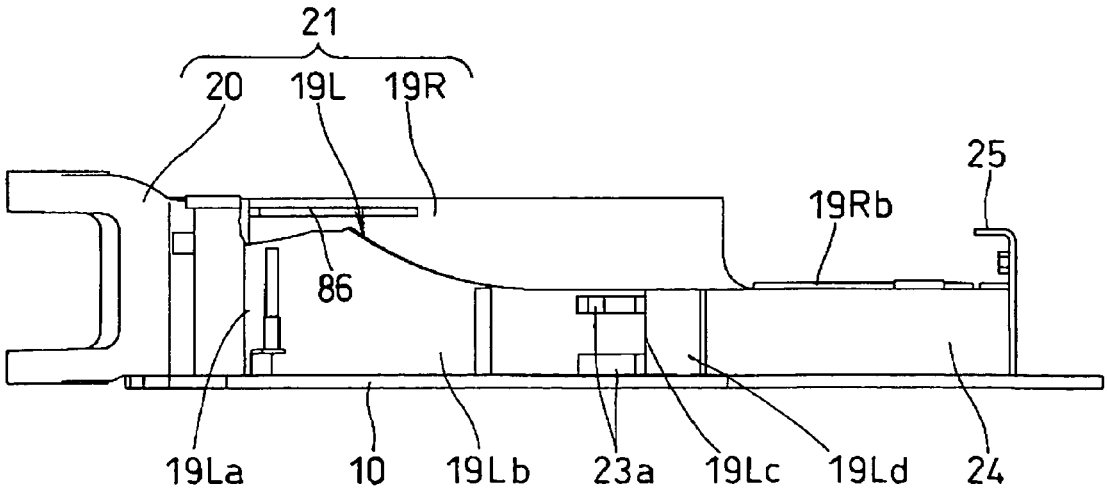
FIG. 10 is a side view of the swivel deck.
Figure 11:
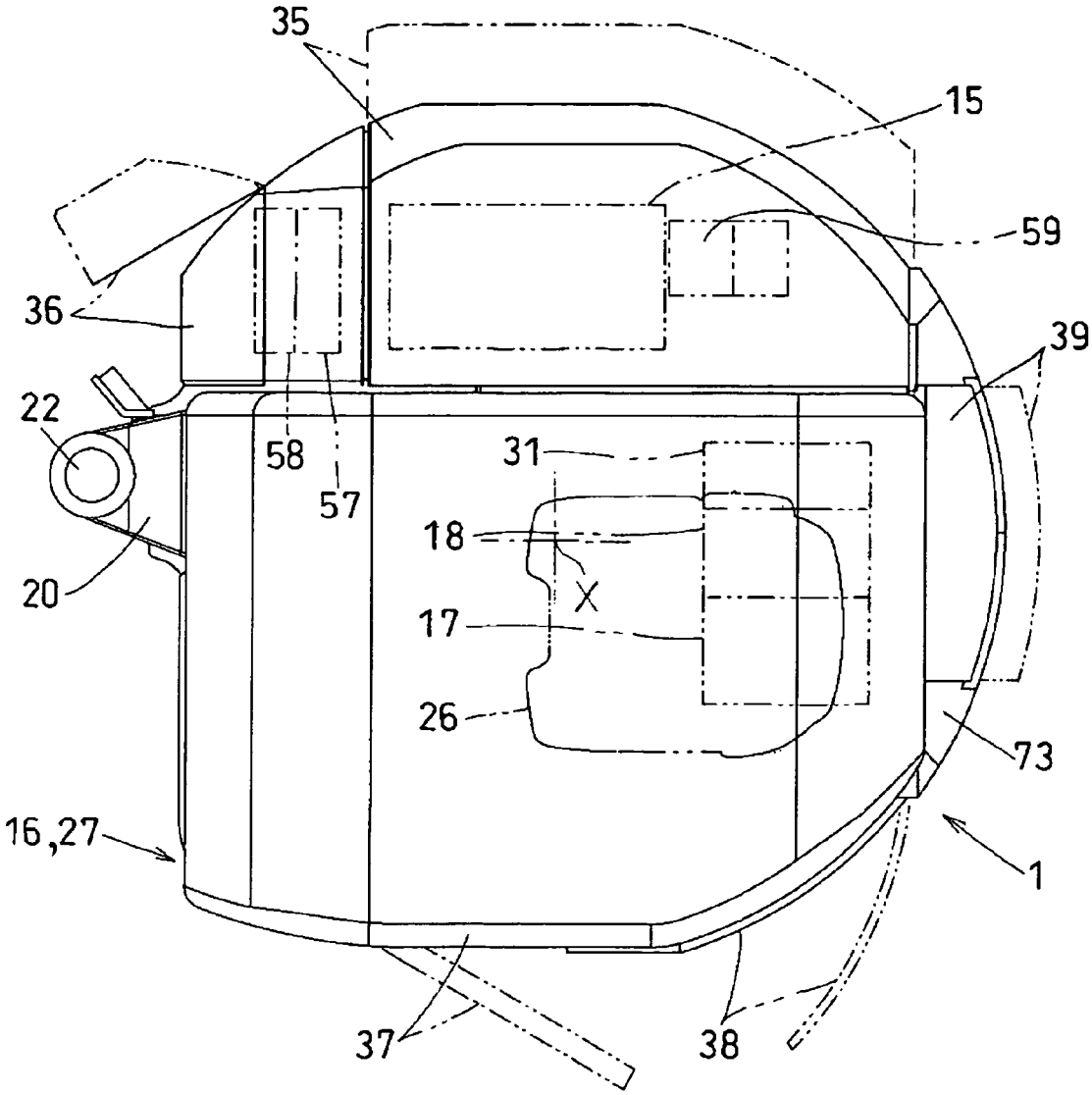
FIG. 11 is a schematic plan view of the upper structure.
Figure 12:
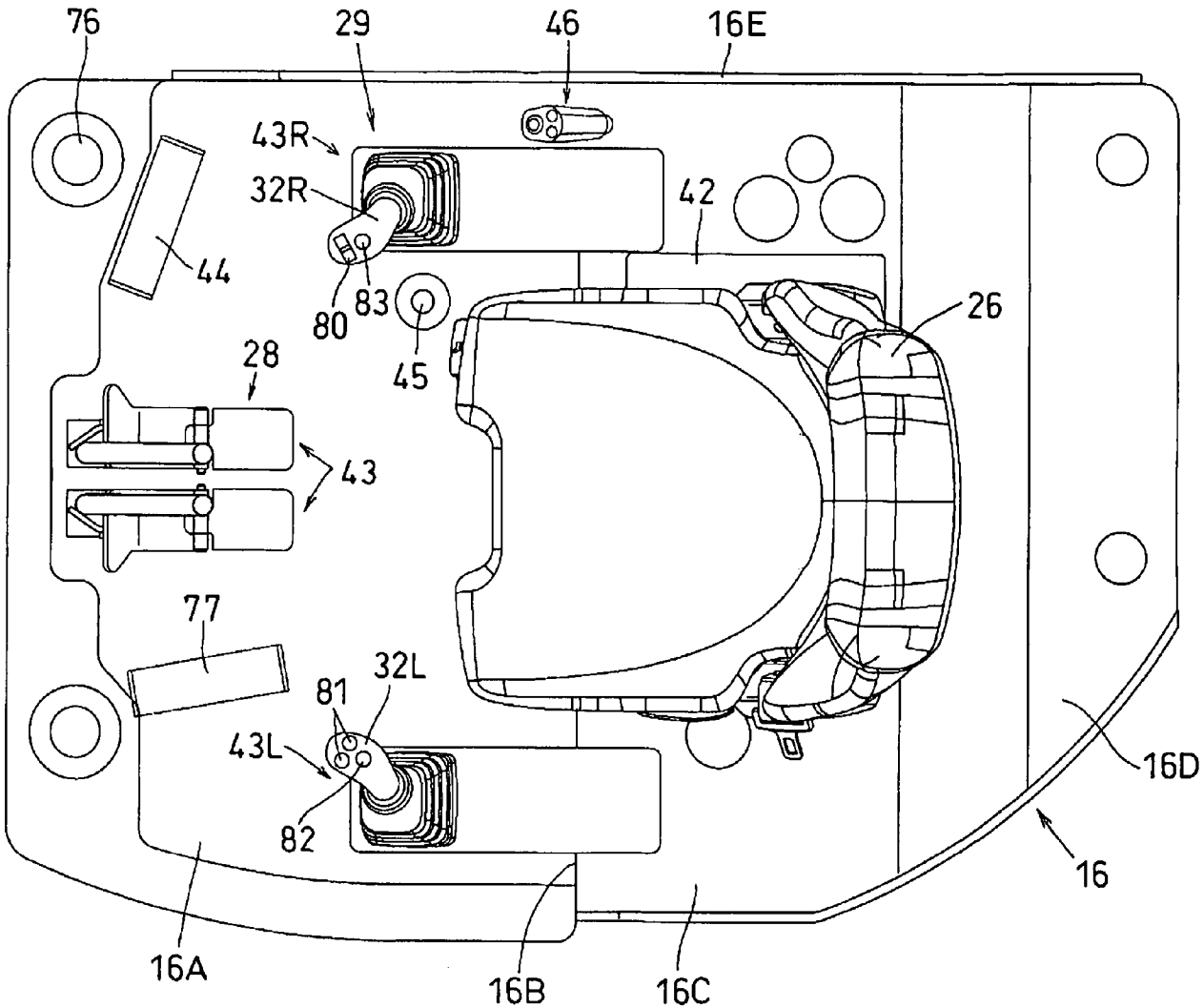
FIG. 12 is a plan view of a platform.
Figure 13:
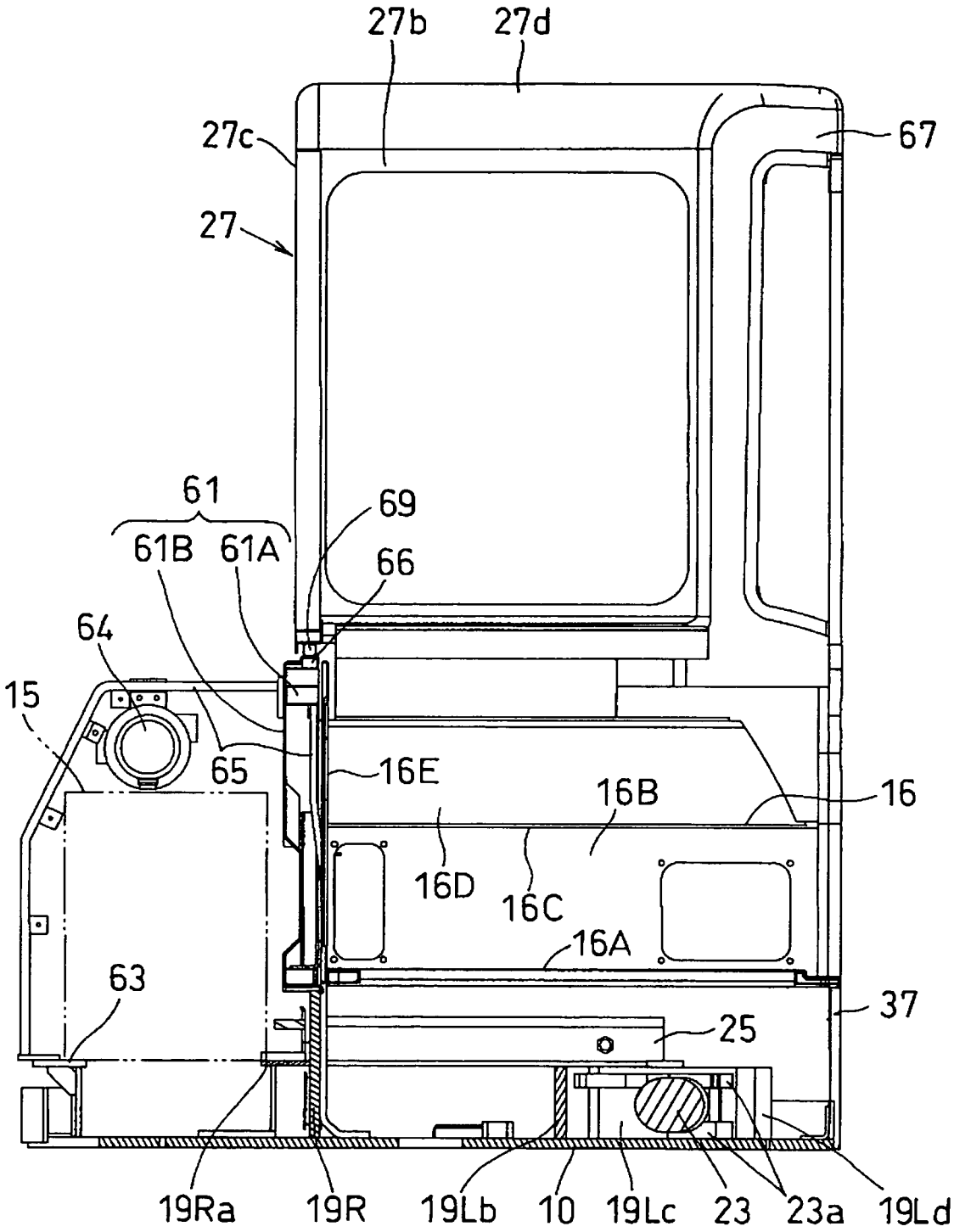
FIG. 13 is a front view, partly in section, of the upper structure.
Figure 14:
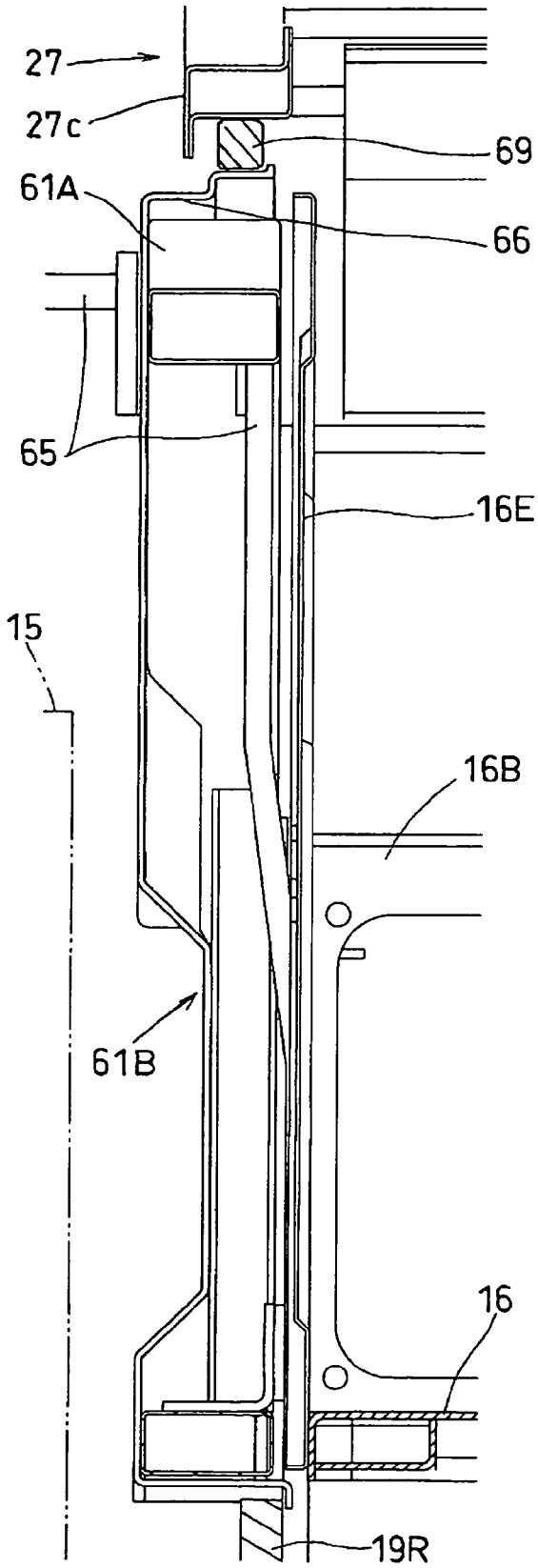
FIG. 14 is an enlarged sectional view of a portion between an engine room and a cab apparatus.

Referring to FIGS. 4, 6 and 7, a mounting frame 30 is provided to extend between the rear longitudinal rib 24 and a rear portion of the right longitudinal rib 19R (or the rear partition plate), straddling the hydraulic oil tank 17 and fuel tank 18. The mounting frame 30 reinforces the rear portion of the support frame 21, and supports a control valve 13.

The hydraulic oil tank 17 and fuel tank 18 are elongated vertically and in the fore and aft direction to have necessary and sufficient capacities. These tanks 17 and 18 are arranged in the right and left direction together with an air-conditioner 31 also elongated vertically and in the fore and aft direction.

The hydraulic oil tank 17 is formed of sheet metal, and fixed to the upper surface of the swivel deck 10. The fuel tank 18 is formed of a synthetic resin, and attached to the hydraulic oil tank 17 with a fork clip 18A. It is also possible to form the hydraulic oil tank 17 with a synthetic resin, and the fuel tank 18 with sheet metal. The fuel tank 18 may be fixed to the swivel deck 10 independently of the hydraulic oil tank 17.

The fuel tank 18 is disposed in the a middle position little influenced by a sideways tilt, so that the fuel may be fetched even when the fuel decreases in quantity and the swivel deck 10 inclines right and left.

A counter weight 73 is mounted at rear of swivel deck 10 and connecting member 25. A battery 74 is mounted at the left side of the swivel deck 10. The counter weight 73 has an opening 73A in an upper middle position for exposing a filling hole 18B of the fuel tank 18. A door 39 is provided to open and close this opening 73A.

The platform 16 extends from above the swing cylinder 23 and battery 74 on the swivel deck 10 to above the hydraulic oil tank 17, fuel tank 18 and counter weight 73. The platform 16 has a front portion thereof detachably attached through cushion material 76 to supporting legs 75 and swing bearing member 20 at the front of the swivel deck 10, and a rear portion to the counter weight 73 (or mounting frame 30).

Referring to FIGS. 4, 5, 12 and 13, the platform 16 is formed of sheet metal or synthetic resin as a unit. The platform 16 has a step portion 16A defining a step surface above the swing cylinder 23 and battery 74, a vertical portion 16B extending upward from the rear end of the step portion 16A and located forwardly of the hydraulic oil tank 17 and fuel tank 18, a mounting portion extending from the upper end of the vertical portion 16B above the hydraulic oil tank 17 and fuel tank 18 and defining a driver's seat mounting surface, a rear connecting portion 16D from the rear end of the mounting portion 16C rearward and upward above the counter weight 73, and a side wall 16E extending upward from side edges adjacent the engine of these step portion 16A, vertical portion 16B, mounting portion 16C and rear connecting portion 16D.

A driver's seat mounting base 42 is supported through a suspension 41 on the mounting portion 16C of the platform 16. The driver's seat 26 and a control device 29 are arranged on the driver's seat mounting base 42. When the driver's seat 26 is rocked a great deal up and down, the control device 29 is rocked with the driver's seat 26. The mounting portion 16C is disposed below the top of the engine 15, and at least an upper part of the engine room 14. The mounting portion 16C disposed at a low level allows use of the suspension 41 even if the driver's seat 26 is at the same height as in the prior art.

Thus, the driver's seat 26 is disposed at a proper height and in a proper fore and aft position without being obstructed by the engine which is the bulkiest object on the swivel deck 10, and by the hydraulic oil tank 17 and fuel tank 18. The hydraulic oil tank 17, fuel tank 18 and air-conditioner 31 below the driver's seat 26 are similar in shape as noted hereinbefore, which is used to arrange these components compactly on the swivel deck 10.

The platform 16 has also travel controls 28 arranged thereon, and can serve as a bottom plate of the cab apparatus 27. The cab apparatus 27 has a cab main body 27A mounted on the platform 16 and enclosing the driver's seat 26, controls 28 and control device 29.

Referring to FIGS. 1-3 and 11-14, the cab main body 27A is formed of a front portion 27*a* having a windshield, a rear portion 27*b* having a glass window, an upper side wall 27*c* having a side window adjacent the engine, and a left side portion having a ceiling 27*d* and a door 67. A lower right side of the cab main body 27A is formed of the side wall 16E of the platform 16. The side wall 16E can also serve as a side wall of engine room 14.

The upper side wall 27*c* overhangs the longitudinal frame 61 and an elastic seal element 69 is disposed therebetween. Thus, rain water does not enter the cab apparatus 27 even when the cab apparatus 27 vibrates vertically relative to the swivel deck 10.

The controls 28 on the platform 16 include propelling control means 43 of the pedal-lever interlock type disposed forwardly of the driver's seat 26, swing cylinder control means 44 operable by the right foot, a foot-operated change switch 45 operable one of the right and left feet to switch between two, high and low speeds of the traveling device 2, and a hand-operated change switch 46 arranged at the same side as the foot-operated change switch 45 and operable by hand.

The foot-operated change switch 45 for switching between two, high and low speeds of the traveling device 2, and hand-operated change switch 46, are arranged in positions operable by the right foot and right hand of the driver seated on the driver's seat 26.

A foot pedal 77 is disposed in a left forward position on the platform 16 to be operable by the left foot for supplying hydraulic fluid to hydraulic equipment associated with the ground working implement 5.

The control device 29 has two grip type work control means 43R and 43L arranged at the right and left sides of the driver's seat 26, with two grips 32 sharing a plurality of operations of the ground working implement 5. The driver can swing the left grip type work control means 43L upwards in time of boarding or alighting.

Each of the grips 32R and 32L of the two grip type work control means 43R and 43L has a pilot valve assigned thereto for pilot operation of the hydraulic equipment constituting the ground working implement 5, such as the motor 8, a boom cylinder 52, an arm cylinder 54 and a working tool cylinder 56. Each grip has also, assigned thereto, a switch for supplying hydraulic fluid to other hydraulic equipment, if any, constituting the ground working implement 5, and/or hydraulic equipment such as a breaker, if any, associated with the ground working implements 5.

The right (i.e. one) grip 32R, for example, has a volume switch 80 and a horn switch 83 for supplying hydraulic fluid to the hydraulic equipment associated with the ground working implement 5. The left (i.e. the other) grip 32L has a control switch 81 and a change switch 82 for selectively operating the two types of hydraulic equipment.

When the ground working implement 5 includes a boom 51 having two members for flexion, the control switch 81 may be a two-piece switch for supplying hydraulic fluid to a flexion cylinder for flexing the second boom relative to the first boom. When the hydraulic equipment associated with the ground working implement 5 has two hydraulic drivers, the control switch 81 may be a second implement switch for supplying hydraulic fluid to the second hydraulic driver. When the two types of hydraulic equipment are used, only one control switch 81 may be provided, and the change switch 82 may be operated for selectively using the two types of hydraulic equipment. The change switch 82 may be adapted to turn the control switch 81 on and off.

Numeral 85 denotes a monitor disposed in an upper right position of the platform 16 for displays running and working states. The monitor 85 is attached to the side wall 16E (or on a strut erected on the step 16A).

Referring to FIGS. 2, 3, 5 and 11, the upper structure 3 has, provided to be openable and closable, the hood 35 for covering the upper plane and outer plane of the engine room 14, a front cover 36 for covering the front plane of the engine room 14 at the front of the cover portion 66A, and a lower side cover 37 for covering the space where the swing cylinder 23 and battery 74 are arranged, in a position between the swivel deck 10 and the front of the platform 16. The swivel deck 10 has outer edges protruding laterally outward to minimize the chance of the hood 35; front cover 36 and lower side cover 37 contacting obstacles.

A pivotal support pivotally supporting the upper end of the hood 35It has an axis extending in the fore and aft direction. A pivotal support pivotally supporting the lower end of the front cover 36 has an axis extending horizontally (or vertically). A pivotal support pivotally supporting the front end of the lower side cover 37 has an axis extending vertically.

The control valve 13 is disposed between the swivel deck 10 and the rear of the platform 16 and laterally outwardly of the hydraulic oil tank 17. The control valve 13 is covered by an openable rear side cover 38. A pivotal support pivotally supporting the rear end of the rear side cover 38 has an axis extending vertically. The rear side cover 38 may have a pivotal support in a lower front position thereof to be openable about a transverse axis.

The control valve 13 is mounted in a rear side position of the swivel deck 10 adjacent the oil tank 17 through the mounting frame 30. A relay junction 70 is mounted in a position of the platform 16 adjacent the control valve 13.

The relay junction 70 has a hose connected thereto and communicating with the controls 28 and control device 29 on the platform 16. These are attached to the swivel deck 10 after being assembled, and the relay junction 70 and control valve 13 are connected to each other through the hose. Thus, piping of the swivel deck 10 and piping of the platform 16 made into assemblies, respectively, to be connected easily.

Referring to FIG. 1, the ground working implement 5 includes a swing bracket 50 pivotally supported by swing bearing member 20 of the support frame 21 to be swingable through a swing shaft 22, the boom 51 connected to the swing bracket 50 to be vertically movable by the boom cylinder 52, an arm 53 connected to the boom 51 to be pivotable about a transverse axis by the arm cylinder 54, and a working tool (bucket) 55 connected to the arm 53 and driven by the working tool cylinder 56 to perform scoop operations. The boom 51 may be a two-piece boom having two flexible members. The arm 53 or working tool 55 may have, associated therewith, one or two hydraulic devices having one or two hydraulic drivers.

According to this invention, the shape of each member in the described embodiment and the positional relationship in the fore and aft, right and left, and vertical directions are optimal when arranged as shown in FIGS. 1-14. However, their arrangement is not limited to the above embodiment. The members and constructions may be modified in various ways, or the combinations may be changed.

For example, the radiator 57 may be disposed rearwardly of the engine 15, and the hydraulic pump 59 forwardly of the engine 15. It is possible to reverse the right and left arrangement of the engine 15, platform 16 and cab apparatus 27 on the swivel deck 10, and the right and left configuration of the support frame 21.

Instead of the cab main body 27A, a driver's seat protection frame of the two strut type may be erected on the rear of the platform 16 rearwardly of the driver's seat 26. A driver's seat protection frame of the four strut type may be erected, which has rear struts at the rear of the platform 16, front struts at the front of the swivel deck 10, and a shading roof.

What is claimed is:

1. A backhoe comprising:

a swivel deck;

a swing bearing member for supporting a ground working implement through a swing shaft;

a first longitudinal rib disposed on said swivel deck, said first longitudinal rib extending in a fore and aft direction, and having a front portion thereof extending in a transverse direction across a rear surface of said swing bearing member, said rear surface of said swing bearing member being attached to said front portion of said first longitudinal rib; and a second longitudinal rib disposed on said swivel deck, said second longitudinal rib extending in the fore and aft direction, and having a front end thereof connected to said front portion of said first longitudinal rib.

2. A backhoe as defined in claim 1, wherein said first longitudinal rib includes:

an inclined portion extending rearward and outward from said front portion; and a rear portion extending from a rear end of said inclined portion transversely away from said second longitudinal rib.

3. A backhoe as defined in claim 2, wherein said second longitudinal rib extends from front to rear of said swivel deck, and supports an engine.

4. A backhoe as defined in claim 3, further comprising:

a rear longitudinal rib extending rearward from said rear portion of said first longitudinal rib; and a connecting member for connecting a rear end of said second longitudinal rib and a rear end of said rear longitudinal rib.

5. A backhoe as defined in claim 1, wherein said front portion of said first longitudinal rib has a transverse dimension longer than said rear surface of said swing bearing member, and parts of said front portion protruding right and left serve as welds to said swing bearing member.

* * * * *